US005709163A

United States Patent [19]

Livingston

[11] Patent Number: 5,709,163

[45] Date of Patent: Jan. 20, 1998

[54] COCKPIT OF A BOAT WITH FRESH AIR VENTS

[76] Inventor: David T. Livingston, 4445-54th SW., Seattle, Wash. 98116

[21] Appl. No.: 612,541

[22] Filed: Mar. 8, 1996

[51] Int. Cl.[6] ..... B63B 19/04

[52] U.S. Cl. ..... 114/211; 454/78

[58] Field of Search ..... 114/21, 361, 343; 296/192, 208, 159; 454/78, 81, 82

[56] References Cited

U.S. PATENT DOCUMENTS

| | | | |
|---|---|---|---|
| 3,290,706 | 12/1966 | Hale | 114/361 |
| 4,293,759 | 10/1981 | Higgins | 454/159 |
| 4,881,484 | 11/1989 | Cavanaugh | 114/361 |
| 4,970,946 | 11/1990 | Ivey | 114/211 |

FOREIGN PATENT DOCUMENTS

| | | | |
|---|---|---|---|
| 633859 | 2/1962 | Italy | 296/208 |

*Primary Examiner*—Sherman Basinger

*Attorney, Agent, or Firm*—Christensen O'Connor Johnson & Kindness PLLC

[57] ABSTRACT

The invention provides a naturally vented cockpit of a boat. To achieve this natural ventilation, the invention utilizes the high pressure zone formed when air flows over surfaces of a boat and is forced to change flow direction, when the boat is in forward motion. One of these zones is located in the vicinity of the base of the windshield and the foredeck of the boat. An air scoop is located in this vicinity to funnel air into an air passage that extends beneath the windshield and into the cockpit. The terminal end of the air passage is preferably located near the base of the inside surface of the windshield to direct air onto the windshield, thereby minimizing the risk of fogging and condensation on its surface. Moreover, the fresh air entering from the air scoops can be used to maintain a slightly positive pressure in a cockpit that is under full canvas. As a result, the concentration of combustion of gases in the cockpit is reduced, providing a healthier environment for the occupants.

15 Claims, 2 Drawing Sheets

COCKPIT OF A BOAT WITH FRESH AIR VENTS

FIELD OF THE INVENTION

The invention relates to the provision of fresh air for the cockpits of boats. More particularly, the invention provides a method of inducting fresh air into a boat cockpit to both minimize the formation of condensation on inside surfaces of windshields, and reduce the concentration of carbon monoxide, and other combustion off gases, in the cockpit of a powered boat.

BACKGROUND OF THE INVENTION

Boats have been used for hundreds of years to travel from one continent to another, to fish the seas, and, increasingly in recent years, for recreation. During this time, the nature of boats has changed significantly due to the development of new technologies. These technologies have provided boats that are more efficient in use of fuel, that have lower drag when traveling through water, that are faster, safer and easier to operate, and that are less prone to risks posed by the vagaries of nature. Users of boats of all kinds have come to expect continually improving performance and features.

One of the as yet unsolved problems encountered in boats, whether used for recreation or commercial fishing, or other purposes, is the tendency for condensate to form on inside surfaces of windshields when the temperature inside the cockpit falls below the dew point temperature of the air in the cockpit. This condition is exacerbated in boats where occupants are close to the windshields so that their humid exhaled breath causes fogging of the windshield. This condition is particularly acute when the weather is cold and the cockpit is under full canvas so that air circulation into the cockpit is restricted. While this restriction of airflow reduces the dissipation of heat out of the cockpit, making the cockpit more comfortable for its occupants, it contributes to increased relative humidity in the cockpit and resultant condensation. Condensation on the windshield is a nuisance and may pose a hazard under certain conditions when visibility is significantly affected.

Another problem, encountered in motorized boats that are traveling with a partially enclosed cockpit, is the induction of exhaust gases into the cockpit. These exhaust gases contain noxious products of fuel combustion, including carbon monoxide. Carbon monoxide is a deadly gas that combines with hemoglobin in the blood thereby precluding the combination of hemoglobin with oxygen. As a result, a person breathing carbon monoxide will gradually suffocate because of a reduced capability to absorb oxygen into the bloodstream.

There exists a need for an apparatus that will prevent, or minimize, the formation of condensate on the inside surfaces of windshields of cockpits of boats. Preferably, the apparatus should be of low cost, and relatively easy to install and maintain. There also exists a need for a method or an apparatus that will eliminate or reduce the concentration of carbon monoxide in a partially enclosed cockpit of a motorized boat. Preferably, the apparatus should operate automatically when the boat is moving under power. Also, the apparatus should be of low cost, and relatively easy to install and maintain.

SUMMARY OF THE INVENTION

The invention provides a naturally ventilated cockpit of a boat. The cockpit includes a windshield that surrounds the front end of the cockpit. A base of the windshield extends downward so that its plane intersects the plane of the substantially horizontal deck of the boat. An air scoop is located in the vicinity of the intersection of the planes of the windshield and the deck. This air scoop funnels air into an air passage that extends beneath the windshield and into the cockpit. The terminal end of the air passage inside the cockpit is preferably near an inside surface of the windshield so that air from the deflector is distributed onto inside surfaces of the windshield.

The air scoop may be in any one of the variety of shapes and designs. However, in one embodiment of the invention, the scoop has a flat longitudinal base, that is coextensive with the flowing lines of the foredeck of the boat. The base is bounded on each side by a longitudinally extending vertical side wall. A cap extends across the upper ends of the side walls so that a mouth of the scoop is defined by leading edges of the side walls and the cap, and the base. In an alternative embodiment, the base of the air scoop is integrally formed with the foredeck of the boat and is in the form of a longitudinal trough with narrowest, shallowest end at a front end and widest, deepest end at the rear, in the vicinity of the windshield. A cap, with its upper surface coextensive with the upper surface of foredeck, extends across a rear portion of the trough so that a mouth of the scoop is defined by the leading edge of the cap and the trough.

Optionally, for more effective defogging of the windshield, an electrically operated heater may be installed in the air passage of the air scoop to heat air before it enters the cockpit. This raises the air temperature to above its dewpoint temperature and also heats the windshield to minimize the risk of fogging.

The naturally ventilated cockpit of the invention takes advantage of a zone of high pressure that forms naturally at the intersection between the planes of the windshield and the horizontal deck of the boat, when the boat is in forward motion. This higher pressure air is funneled into the air scoop, carded along an air passage, and flows into the cockpit, preferably onto inside surfaces of the windshield. The flow of this air, from outside the cockpit, onto the windshield sweeps more humid air away from the windshield thereby preventing the formation of condensate. Moreover, the air flowing into the cockpit from the area ahead of the cockpit is not contaminated with carbon monoxide, or other combustion product gases. As a result of inflow of this fresh air into the cockpit, the concentration of combustion product gases in the cockpit is reduced. Also, in the case of an enclosed cockpit, the interior of the cockpit can be maintained at a slightly positive pressure, relative to the pressure behind the cockpit, so that combustion product gases cannot be drawn into the cockpit, by suction, from behind the cockpit when the boat is underway.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The invention provides a naturally ventilated cockpit of a boat. The natural ventilation is achieved by taking advantage of a zone of high pressure that forms at the intersection of substantially horizontal surfaces, and surfaces inclined at an angle to the horizontal, when the boat is in motion. The pressure in these zones increases as the speed of the boat increases due to natural fluid dynamic phenomena. In particular, the invention takes advantage of the zone of high pressure that is formed at the intersection of a plane extending through a substantially horizontal foredeck of a boat, with a plane extending through a windshield inclined at an angle β relative to the plane of the foredeck. When the boat is in motion, air sweeps over the deck to collide with the windscreen, and then flows upward and over the windscreen. As a result, a high air pressure zone is located in the vicinity of the base of the windscreen. Of course, other high pressure zones may similarly be formed elsewhere on the boat, and it is within the contemplation of the invention to utilize these high pressure zones to channel air into the cockpit, as described herebelow.

Figure 1:
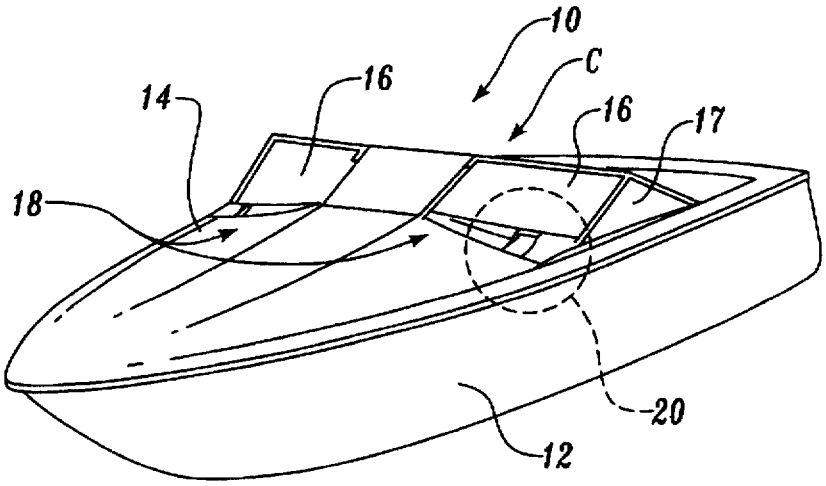
FIG. 1 is a perspective view of a boat including an embodiment of the cockpit vent of the invention.

The invention may be better understood with reference to the attached FIGURES, illustrating schematically preferred embodiments of the naturally ventilated cockpit and air scoop of the invention. As shown in FIG. 1, a boat 10 has a hull 12 onto which is mounted a foredeck 14 extending from the stem of the boat to about midway along the length of the boat. The cockpit is located near the stem portion of the boat and is bounded at its front end by a pair of upwardly and rearwardly angled windshields 16, each flanked by a side window 17 that extends substantially parallel to a side of the boat. As shown more clearly in FIG. 3, the windshields 16 are angled rearward away from the foredeck 14 at an obtuse angle β. So that when air flows over the deck, when the boat is in motion, the air impacts the base of the windshield 16 and is deflected upward and over the windshield. As explained above, this creates the zone of high pressure 18 in the vicinity of the base of the windshield 16.

Figure 2:
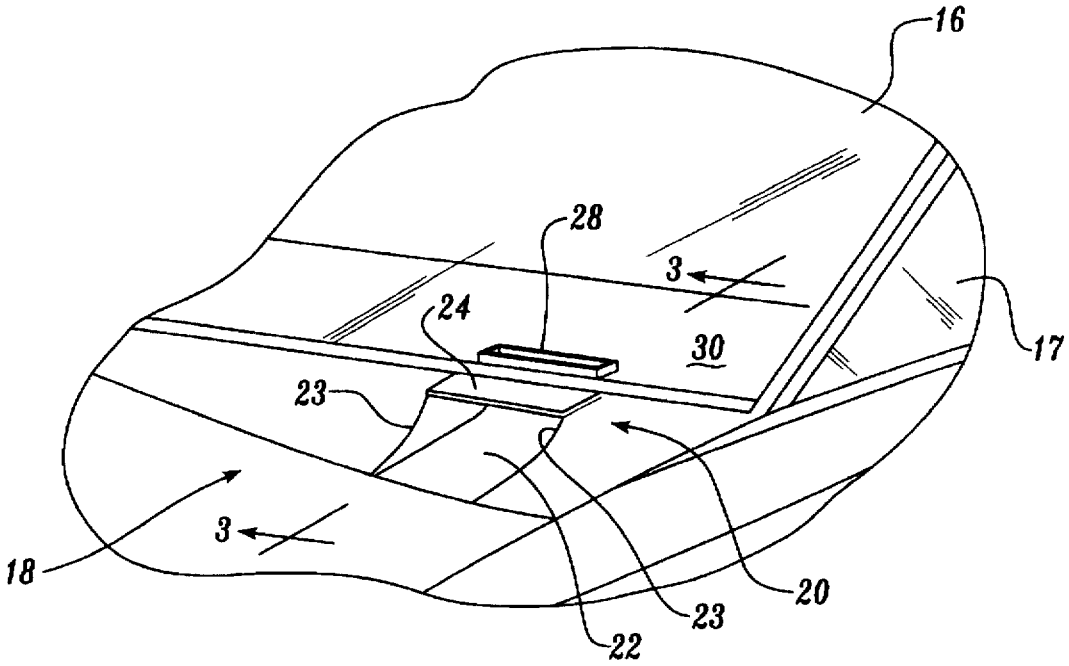
FIG. 2 is an enlarged view illustrating the embodiment of the invention of FIG. 1.
Figure 3:
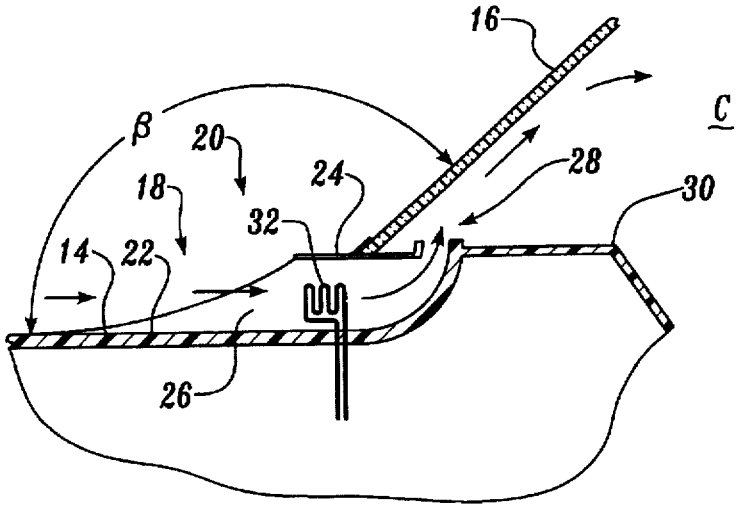
FIG. 3 is a schematic cross sectional view taken at 3—3 of FIG. 2, showing the motion of air into the vent and onto an inner surface of a windscreen of the cockpit of the boat.

Referring to FIGS. 2 and 3, the embodiment of the air scoop 20 of the invention shown, has a base or lower surface 22 that is coextensive with the surface of the deck 14. The scoop has two vertical side walls 23 extending vertically upward from either side of the base 22. The upper ends of these vertical sides are capped with a horizontal planar air scoop cover 24. Thus, the leading edges of the base, sides, and cap form a mouth of the air scoop that is oriented forward of the cockpit, towards the bow of the boat, to efficiently funnel air into the air scoop when the boat is in motion. Once funneled into the air scoop, the air travels along a substantially horizontal passage 26 of the scoop, that extends beneath the windshield 16, and then exits from a terminal end 28 of the passage is located inside the cockpit. Preferably, the terminal end 28 of the passage is located on the dashboard 30 of the cockpit and near the base of the windshield 16 so that air exiting from the terminal end impinges upon the windshield and flows across a substantial proportion of its surface. This impact and sweeping movement of incoming air across the windshield sweeps away humid air and prevents, or minimizes, the tendency for condensate or fog to form on the inside surface of the windshield.

Optionally, an air preheater 32, such as a resistance heater, may be placed inside the air passage 26 to heat the air before the air exits from the terminal end of the passage. Such heated air is effective in both heating the windshield and also increasing the dew point temperature of air in the vicinity of the windshield thereby further reducing the risk of condensate or fog forming on the inside surface of the windshield.

Figure 4:
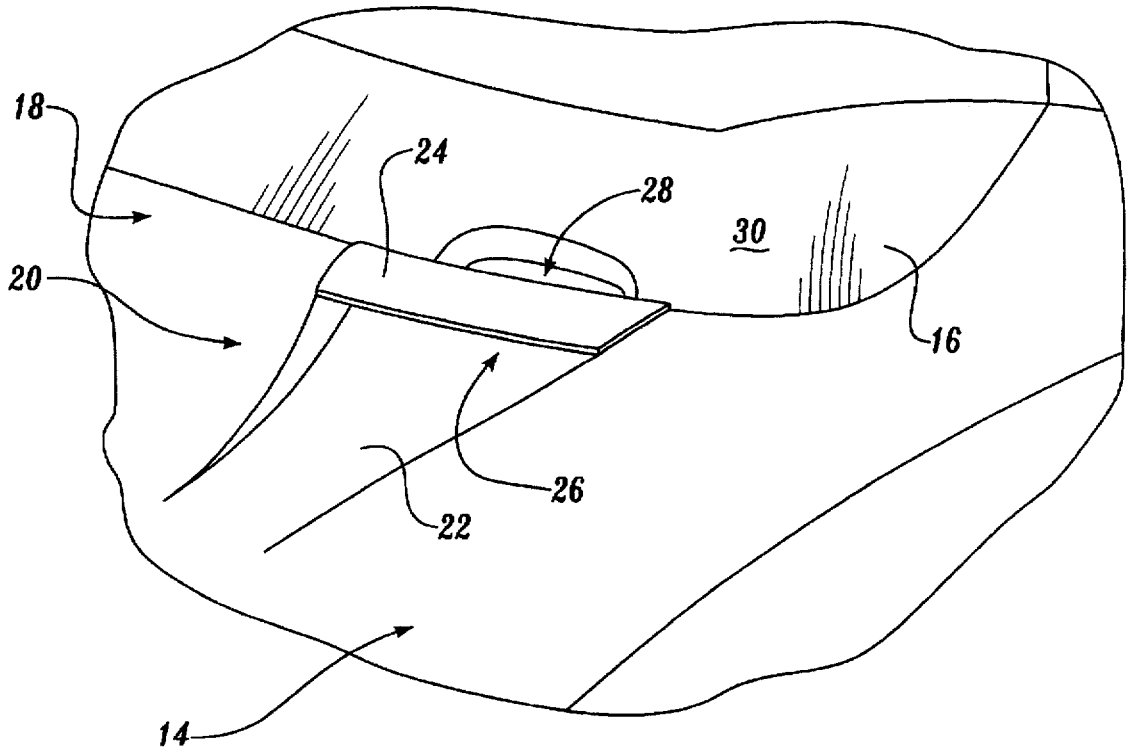
FIG. 4 is a schematic perspective view of another embodiment of an air scoop of the invention ventilated cockpit.

In an alternative embodiment, illustrated schematically in FIG. 4, the air scoop 20 is integrally formed into the deck of the boat. This provides an aesthetically pleasing and more aerodynamic air scoop. Thus, the base 22 of the air scoop 20 is formed by a longitudinal depression or channel that has a shallowest, narrowest forward end directed toward the stem of the boat, and a deepest, widest rear end near the windshield 16. The cap 24 of the air scoop 20 has an upper surface coextensive with the upper surface of the deck 14 providing the integral air scoop with a clean unitary appearance. The leading edge of the cap and the channel 22 form a mouth of the scoop that is oriented forward of the cockpit for funneling or directing air under pressure into the scoop when the boat is in motion. Optionally, the cap may also be integrally formed with the foredeck of the boat and may protrude upward to form a "power bulge" to admit more air. As in the embodiment described above, the scoop of FIG. 4 has an air passage 26 beneath the cap 24 and the windshield. The channel extends rearward by just behind the windshield 16 and to a terminal opening 28 in the cockpit. The terminal end of the passage is, as described above, preferably located near the base of the windshield 16 to distribute air across the windshield.

Importantly, the invention not only supplies air to a cockpit for the purpose of preventing condensation of moisture onto inside surfaces of windshields, but also provides fresh clean air from forward of the boat. Typically, when the boat is in motion, a relatively lower pressure area is formed behind the windshield 16, in the cockpit. This lower pressure area induces combustion off gases into the cockpit area. Normally, when the cockpit is open, this does not pose a significant health hazard. However, when the cockpit is under full canvas, then the concentration of these combustion off gases can rise to undesirably high concentrations. In accordance with the invention, the air scoop 20 supplies a sufficient quantity of air to provide a slightly positive pressure in the canvas covered cabin thereby precluding the suction of combustion off gases into the cockpit. Alternatively, when the quantity of air flow is reduced, such as when the velocity of the boat is reduced, then the quantity of air is sufficient to at least reduce the concentration of combustion off gases that might seep into a canvas covered cockpit. Of course, when the velocity of the boat is reduced, suction forces that might induce combustion of gases into the canvas covered cockpit are also reduced, since the degree of pressure reduction within the cockpit is directly related to the speed of travel of the boat. Thus, less air is required from the air scoops to achieve either a positive pressure in the cockpit or to dilute the concentration of combustion off gases in the cockpit.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A naturally ventilated cockpit of a boat, the cockpit comprising:

an air scoop located outside the cockpit, in the vicinity of a zone of increasing air pressure, the zone located at an intersection of a plane of a first substantially horizontal surface above the hull of the boat with a plane of a second surface, inclined at an angle β to the first surface for directing airflow over the second surface when the boat is in motion, the zone located outside and forward of the cockpit so that air pressure increases in the zone when the boat is brought into forward motion, the air scoop having a mouth facing substantially forward of the cockpit to intercept high pressure air, when the boat is in forward motion, the air scoop comprising an air passage extending from the mouth of the air scoop to the interior of the cockpit, the air scoop being integral to the first horizontal surface and aerodynamically shaped to funnel air into the air passage, the air passage being substantially horizontal and curving upward near a terminal end thereof and in fluid communication with the interior of the cockpit to direct air upward into the cockpit and onto an inside surface of the second surface from forward of the boat, when the boat is in forward motion.

2. The cockpit of claim 1, wherein the first surface is a deck of the boat, and the second surface is a windshield; and the zone of increasing pressure is located in the vicinity of a base of the windshield.

3. The cockpit of claim 1, wherein the air scoop comprises a mouth portion formed by leading edges of longitudinally extending vertical side walls on either side of a longitudinally extending base of the scoop and a cap extending across upper ends of the side walls, the mouth portion oriented to face forward of the cockpit to funnel air into the scoop when the boat is in forward motion.

4. The cockpit of claim 1, wherein the angle β is an obtuse angle between the planes of the first and second surfaces.

5. A naturally ventilated cockpit of a boat, the cockpit comprising:

(a) a windshield at a frontal end of the cockpit, the windshield extending upward at an angle β relative to a substantially horizontal foredeck of the boat to form an intersecting zone between a base of the windshield and the foredeck;

(b) an air scoop integrally formed with the foredeck in the vicinity of the intersecting zone of the base of the windshield with the deck, the air scoop comprising a substantially horizontal air passage extending beneath the windshield and being integrally curved upward near a terminal end thereof into the cockpit, the air passage able to carry air from outside the cockpit through the air scoop to an interior of the cockpit when the boat is in forward motion; and (c) an air deflector integrally formed at the terminal end of the air passage inside the cockpit and near an inside surface of the windshield, the deflector able to distribute air on the inside surface of the windshield when the boat is in motion.

6. The cockpit of claim 5, wherein the air scoop comprises a mouth portion formed by leading edges of longitudinally extending vertical side walls on either side of a longitudinally extending base of the scoop and a cap extending across upper ends of the side walls, the mouth portion oriented to face forward of the cockpit to funnel air into the scoop when the boat is in forward motion.

7. The cockpit of claim 5, wherein a cap covers a rear portion of the integrally formed base of the scoop so that a leading edge of the cap and the integrally formed base form a mouth of the scoop.

8. The cockpit of claim 7, wherein the cap of the scoop is substantially planar and an upper surface of the cap is substantially coextensive with an upper surface of the deck.

9. The cockpit of claim 5, wherein a widest, shallowest portion of the air scoop is nearest a stem of the boat, and a widest, deepest portion of the scoop is near the cockpit so that the scoop is able to funnel air into the air passage.

10. A naturally ventilated cockpit of a boat for minimizing carbon monoxide concentration in the cockpit and reducing moisture condensation on interior surfaces of a windshield of the cockpit, the cockpit comprising:

(a) a windshield at a frontal end of the cockpit, the windshield extending upward at an angle β relative to a substantially horizontal portion of a foredeck of the boat; and (b) an air scoop outside the cockpit in the vicinity of an intersection between the base of the windshield and the substantially horizontal portion of the foredeck of the boat, the air scoop integrally formed with the foredeck and oriented such that a mouth of the air scoop faces forward of the cockpit, the air scoop comprising a substantially horizontal air passage extending from a mouth of the air scoop beneath the windshield to an upwardly curved terminal end in the cockpit, the air passage able to convey air under natural pressure from outside the boat into the cockpit and onto an inside surface of the windshield when the boat is in forward motion.

11. The cockpit of claim 10, wherein the integrally formed scoop is aerodynamically shaped to funnel air into the air passage.

12. The cockpit of claim 10, wherein a lower surface of the air scoop is integrally formed into the foredeck to form a longitudinally extending channel, and a cap covers a rear portion of the integrally formed channel to form a mouth of the air scoop.

13. The cockpit of claim 1, further comprising an air heater disposed in the air passage to heat air passing through the passage.

14. The cockpit of claim 10, further comprising an air heater disposed in the air passage to heat air passing through the passage.

15. The cockpit of claim 5, further comprising an air heater disposed in the air passage to heat air passing through the passage.

* * * * *